US008079157B2

(12) United States Patent
Balerdi Azpilicueta et al.

(10) Patent No.: US 8,079,157 B2
(45) Date of Patent: Dec. 20, 2011

(54) DRYER COMPRISING A HEAT SINK AND A CONDENSATE CONTAINER

(75) Inventors: Pilar Balerdi Azpilicueta, Barindano (ES); Günter Steffens, Dallgow-Döberitz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 357 days.

(21) Appl. No.: 12/472,504

(22) Filed: May 27, 2009

(65) Prior Publication Data

US 2009/0320312 A1 Dec. 31, 2009

(30) Foreign Application Priority Data

Jun. 27, 2008 (EP) ..... 08104572

(51) Int. Cl.
*D06F 58/00* (2006.01)

(52) U.S. Cl. ..... 34/130
(58) Field of Classification Search ..... 34/130, 34/134
See application file for complete search history.

(56) References Cited

U.S. PATENT DOCUMENTS

2009/0031513 A1 2/2009 Goldberg et al.

FOREIGN PATENT DOCUMENTS

| | | | |
|---|---|---|---|
| DE | 3738031 | A1 | 5/1989 |
| EP | 1936022 | A1 | 6/2008 |
| WO | 2007093461 | A1 | 8/2007 |
| WO | 2007093467 | A1 | 8/2007 |

OTHER PUBLICATIONS

JP 2007-330439, translation, Abstract, Specification, Dec. 2007.*

* cited by examiner

*Primary Examiner* — Mark Halpern
(74) *Attorney, Agent, or Firm* — James E. Howard; Andre Pallapies

(57) ABSTRACT

A dryer includes a drying chamber, a process air guide that guides process air along the articles to pick up humidity from them, a heat sink in the process air guide that precipitates humidity from the process air as a condensate, and a condensate collector with a condensate container having an insert that is permeable to the condensate and that projects through an opening into the condensate container for transferring the condensate to and from the condensate container. The insert includes a first filter that filters particles from the condensate prior to storing the condensate in the condensate container.

20 Claims, 3 Drawing Sheets

DRYER COMPRISING A HEAT SINK AND A CONDENSATE CONTAINER

BACKGROUND OF THE INVENTION

The invention relates to a dryer comprising a drying chamber to contain articles to be dried, a process air guide for guiding process air along the articles to pick up humidity from them, a heat sink disposed in the process air guide for precipitating the humidity, the dryer comprising a condensate container to contain the condensate.

A dryer of such type is apparent from each of the patent publications DE 37 38 031 C2, WO 2007/093461 A1, WO 2007/093467 A1, and WO 2007/093468 A1.

According to each of these documents, the condensate collected is applied to clean at least one component of the dryer from lint, in particular a heat sink that is used to extract heat from a flow of process air which is being circulated through the articles to be dried, to precipitate humidity collected from the articles as a condensate. The heat sink in particular is a component of a heat pump, namely an evaporator heat exchanger wherein the heat extracted from the process air is used to evaporate a refrigerant that circulates through the heat pump undergoing cyclic phase changes from liquid to gas and vice versa.

During a drying process, particles like dust or small fibres, hereinafter termed "lint", may be released from the articles to be dried. Lint will occur in particular upon drying laundry or other textiles, in particular when the articles are tumbled in a rotating drum as usual for laundry. An according dryer will comprise a filter that filters such lint from the process air; in general however, a fraction of the lint will escape the filter and be transported further along the path of the process air. Upon cooling the process air in the heat sink subsequently, condensate will precipitate from the process air with the lint that has escaped the filter. Some of the lint thus caught by the condensate will be precipitated on the heat sink and remain sticking there. The liquid condensate collected at the heat sink and conveyed to a condensate container will also contain a substantial amount of lint dispersed therein. As specified in DE 37 38 031 C2, a cleaning device for cleaning the heat sink is provided. The cleaning device includes a distributor directed towards the heat sink and means to spray the condensate thus collected onto the heat sink for removing the lint sticking to it. To prevent the distributor from clogging by lint dispersed in the condensate, it has nozzles with cross sections that are large enough to allow the dispersed lint to pass without clogging. These large cross sections will cause low limits to pressure and velocity of the condensate pressed through, and impair the cleaning effect of the sprayed condensate.

BRIEF SUMMARY OF THE INVENTION

It is an object of the invention to alleviate the problem of limited cleaning effect and provide a dryer which allows for better cleaning of components affected by lint sticking thereto.

Accordingly, there is specified, in accordance with the invention, a dryer comprising a drying chamber to contain articles to be dried, a process air guide for guiding process air along the articles to pick up humidity from them, a heat sink disposed in the process air guide for precipitating the humidity from the process air as a condensate, a condensate collecting device for collecting the condensate comprising a condensate container to contain the condensate, wherein the condensate container has an insert permeable by the condensate and projecting through an opening into the condensate container for transferring the condensate to and from the condensate container, the insert comprising a first filter for filtering particles from the condensate prior to storing the condensate in the condensate container.

In accordance with the invention, provision is made to have the condensate stored in the condensate container substantially free from lint. In addition, condensate from the condensate container may be used more than once for a cleaning process, as the filter will free the used condensate from additional lint collected through the cleaning process. The lint removed from the condensate is collected in a filter that is placed within the condensate collector and is flushed from the filter by the condensate whenever such condensate is emptied from the container after completing a drying process. Thereby, the filter is self-cleaning and will not require particular attention by a user. The invention thus provides for condensate collected through a drying process that is well cleaned for use in any cleaning purpose that may be scheduled in the dryer. Providing and using clean water from another source, in particular tap water can be avoided, contributing both to a positive ecological effect and to operational comfort for a user.

In accordance with an exemplary embodiment of the dryer according to the invention, the insert is removably attached to the condensate container. Thus, the filter can be given a special cleaning treatment whenever a user so desires.

In accordance with another exemplary embodiment of the dryer according to the invention, the first filter is a permeable mesh. The mesh may be a textile, for example a web-like textile made from synthetic fibres.

In accordance with a further exemplary embodiment of the invention, the first filter is arranged to be flushed back for removing particles filtered from the condensate as condensate collected in the condensate container is poured out from the condensate container through the opening with the insert placed therein.

In accordance with yet another exemplary embodiment of the dryer according to the invention, the dryer includes a cleaning device for cleaning the heat sink from particles sticking thereon. The cleaning device includes a liquid guide connected to the condensate container and a valve for guiding condensate from the condensate container to the heat sink, and a distributor for distributing the condensate over the heat sink.

In accordance with still another exemplary embodiment of the dryer according to the invention, the heat sink belongs to a heat pump associated to the process air guide. A heat pump is a machine. Heat is collected into a heat sink, transported to a heat source and distributed again from a heat source, where an operating temperature at the heat sink may be lower than or equal to an operating temperature at the heat source. According to fundamental laws of thermodynamics, a heat pump will not operate unless an amount of energy is consumed, that is converted into excess heat. An according energy input may be substantially lower than the energy spent by the heat distributed from the heat source.

Thereby, the efficiency of a dryer may be improved greatly by replacing a combination of a classical heater as a heat source and a classical cooler or heat exchanger as a heat sink by the respective components of a heat pump.

While a dryer including a heat pump is an exemplary embodiment of the invention, it is noted that the particular type of the heat sink and its inclusion into a more complex aggregate like a heat pump is not a requirement of the invention. It is indeed possible to apply the invention to a dryer that has a heat sink which is a normal air-to-air heat exchanger.

The profits of the invention in such dryer are very much the same as in a dryer comprising a heat pump which includes the heat sink.

In accordance with a further exemplary embodiment of the dryer according to the invention, the dryer includes a blower in the process air guide. The blower drives the process air through the process air guide.

In accordance with yet a further exemplary embodiment of the dryer according to the invention, the process air guide includes a second filter disposed upstream of the heat sink to collect particles from the process air. The second filter collects a part of the lint conveyed by the process air prior to directing the process air to the heat sink, thus limiting the load imposed on the heat sink by lint that is precipitated thereon.

In accordance with a still a further exemplary embodiment of the dryer according to the invention, the condensate container includes a body portion and a cover portion to cover the body portion. The opening is formed in the cover portion.

In accordance with a particularly exemplary embodiment of the dryer according to the invention, the process air guide is a substantially closed circuit, thereby making the dryer a condensation-type dryer.

In accordance with another particularly exemplary embodiment of the dryer according to the invention, the drying chamber is a drum, and a motor is provided in the dryer to drive the drum for drying the articles. This embodiment makes the invention applicable to a laundry dryer for drying articles that are humid laundry. In particular, such laundry dryer includes means for containing the laundry that are defined according to a common practice.

BRIEF DESCRIPTION OF THE DRAWINGS

The invention will now be explained in details by means of exemplary embodiments and components thereof as shown in the attached drawing.

In the drawing.

DETAILED DESCRIPTION OF EXEMPLARY EMBODIMENTS OF THE PRESENT INVENTION

Figure 1:
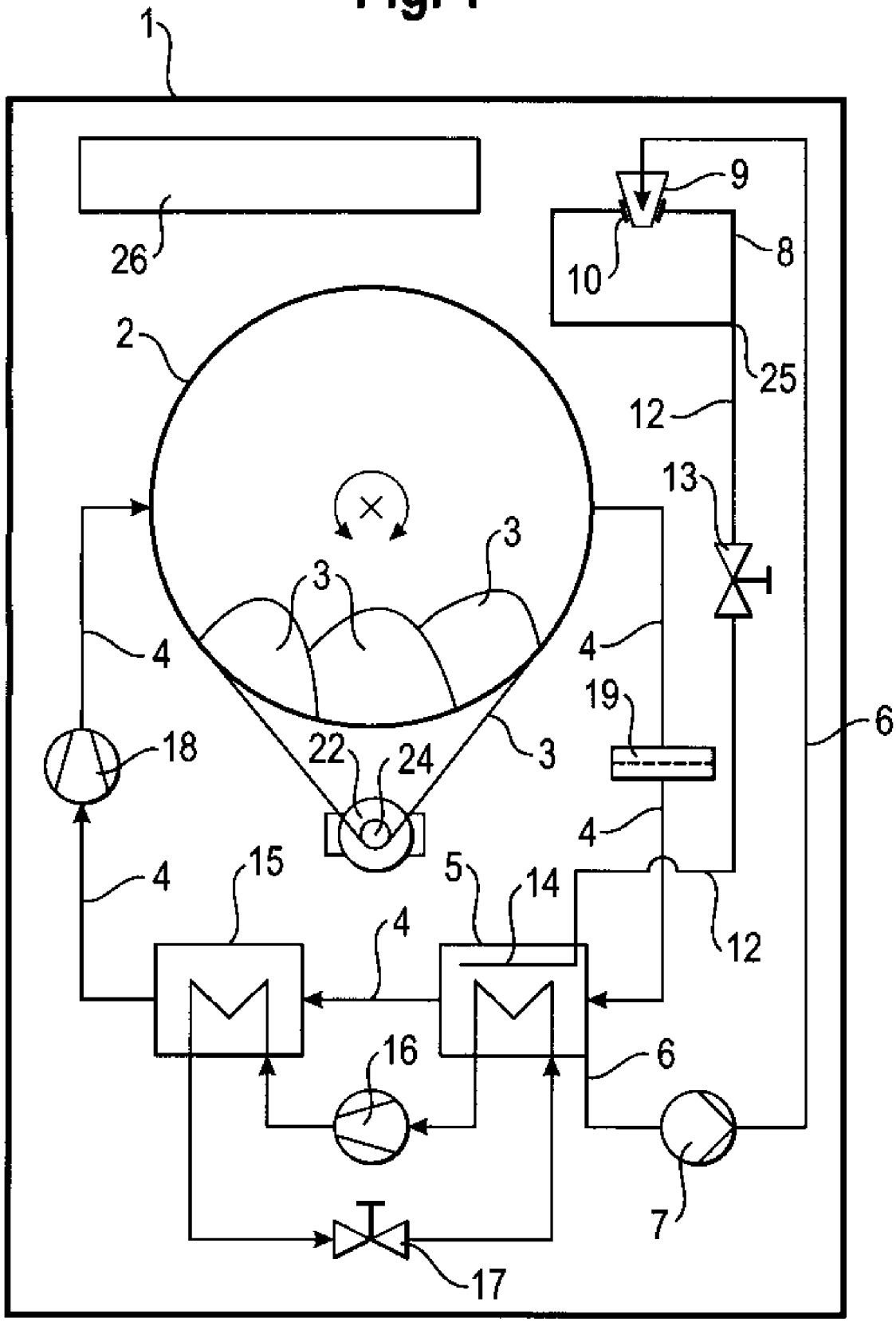
FIG. 1 shows a dryer comprising a heat sink and a condensate container.

According to FIG. 1, the dryer 1 shown is configured as a laundry dryer 1. It includes a drying chamber 2 that is embodied as a rotatable drum 2 and contains articles 3 to be dried, namely humid laundry 3. Process air is guided through the drying chamber 2 and around the laundry 3 within a closed circuit which is defined by process air guide 4. The process air guide 4 includes means to drive the process air, in particular a blower 18, means to heat the process air prior to introducing it into the drying chamber 2, which means are in particular a heat source 15. Further, the process air guide includes means to cool the process air subsequent to passing through the drum 2, in particular the heat sink 5.

As the process air is guided through the heat sink 5, humidity collected by the process air while passing along the humid laundry 3 is precipitated from the process air as a liquid condensate by extracting heat from the process air as it passes through the heat sink 5. Condensate which has precipitated from the process air will be collected by a condensate collecting device 6, 7, 8 including a condensate line 6 which begins at the heat sink 5, a condensate pump 7 and a condensate container 8 where the condensate line 6 ends. Condensate container 8 is provided to contain the condensate as long as the drying process to dry the laundry 3 runs. Upon completing the drying process, all humidity which had been present in the laundry 3 prior to the drying process will have been collected in the form of a liquid condensate in the condensate container 8. The condensate container 8 has an insert 9 that is permeable by condensate and projects through an opening 10 into the condensate container 8. Condensate that is conveyed to the condensate container 8 will enter through the insert 9. Likewise, when the condensate container 8 is extracted from the dryer 1 subsequent to the completion of a drying process for disposing of the condensate, the condensate is poured out of the condensate container 8 via the insert 9. The insert 9 includes a first filter 11 as best seen in FIGS. 2 to 5, to filter particulate matter from the condensate that had been precipitated from the process air concurrently with the condensate, and prevent that particulate matter from entering the condensate container 8 and contaminate the condensate contained therein. Such particulate matter may be lint, namely small and more or less dust-like fibres which are created by tumbling the humid laundry upon rotation of the drying chamber 2 and carried away by the process air. The condensate occurring in the heat sink 5 catches such lint, and precipitates it onto the surfaces of the heat sink 5 which are subjected to the process air. This may lead to a contamination of the heat sink 5 and to an impairment of its function.

As a layer of lint builds up at the heat sink 5, its ability to extract heat from the process air will decline and the efficiency of the dryer one will be reduced accordingly. Therefore, it is desirably to provide for some cleaning of the heat sink 5. In a classical laundry dryer 1 where the heat sink 5 is a heat exchanger wherein the heat from the process air is absorbed into cooling air (or cooling water), the heat sink 5 may be constructed to be removable from the dryer 1 upon completion of a drying process. Thereby the heat sink 5 can be cleaned by a user of the dryer 1. If the heat sink 5 is a component of a heat pump however, it may not be possible to construct the heat sink 5 for removal by a user. In such case, other means need to be provided to allow for appropriate cleaning. In the example as shown in FIG. 1, a cleaning device 12, 13, 14 for cleaning the heat sink 5 is provided. This device includes a liquid guide 12 for transferring condensate from the condensate container 8 to the heat sink 5, a valve 13 to control operation of the device and a distributor 14 associated to the heat sink 5 for distributing condensate arriving through the liquid guide 12 over the heat sink 5 and its surfaces that are exposed to the process air and lint contained therein. Thereby, any lint sticking to the heat sink 5 can be washed off and carried away with condensate that is guided back to the condensate container 8 through condensate line 6 and condensate pump 7. Any lint which has been conveyed through the condensate line 6 thereby will collect at the first filter 11 of insert 9 and be prevented from entering the condensate container 8. Thereby, the lint is collected in the insert 9 for later disposal, and the condensate which is again contained in the condensate container 8 is ready for another cleaning operation, if that should be desired. To remove the lint from the first filter 11, the insert 9 with the first filter 11 and lint collected may be removed from the condensate container 8. As the insert 9 is placed in the opening 10 that also serves to pour out condensate collected in the condensate container 8, the first filter 11 in the insert 9 will be flushed back by condensate that is being poured out through the opening 10 and the insert 9 contained therein. Thereby, the lint collected will be removed from the container 8 concurrently with the condensate in a single operation.

As indicated before, the heat sink 5 belongs to a heat pump 5, 15, 16, 17 that is associated to the process air guide 4. The heat pump 5, 15, 16, 17 further includes a heat source 15 which is applied to transfer heat into the process air passing through. Pumping of heat from the heat sink 5 to the heat source 15 occurs by virtue of a refrigerant, in particular a fluorinated hydrocarbon compound or a mixture of such compounds, which is circulated in a closed circuit wherein it is driven by a compressor 16 and wherein it is subjected to a throttling process when passing through a throttle 17. Operation of the heat pump 5, 15, 16, 17 is as follows: The refrigerant reaches the heat sink 5 as a liquid at a relatively low pressure level. In the heat sink 5, the refrigerant absorbs heat from the process air and is evaporated thereby, assuming a gas state. The refrigerant in such gas state is subsequently compressed by compressor 16 to a relatively high pressure level and conveyed to the heat source 15. In the heat source 15, heat from the refrigerant is transferred to the process air, and as a consequence the refrigerant condenses to a liquid state again. In its liquid state, the refrigerant is forwarded to the throttle 17 which serves to reduce the internal pressure of the refrigerant to the lower pressure level. Subsequently, the refrigerant is conveyed to the heat sink 5 again, thereby closing the circuit, to repeat the cycle of evaporation and condensation as explained. It is material for the heat pump 5, 15, 16, 17, to retain the refrigerant through its complete life cycle. Accordingly, the circuit must be perfectly sealed against any loss of refrigerant. Accordingly, it is not possible to remove the heat sink 5 for the purpose of cleaning or whatever.

The heat sink 5 and the heat source 15 shown in FIG. 1 are indeed understood as components of a heat pump principally as further elaborated in and by reference to FIG. 1. In addition, they should as well be understood as representatives of all known or obvious kinds of such components. In particular, the heat sink 5 may be an air-to-air heat exchanger, and the heat source 15 may be a classical resistive heater.

The process air guide 4 includes a blower 18 to drive the process air which flows in its own closed circuit, and it contains as well a second filter 19 placed between the drying chamber 2 and the heat sink 5 to collect a major share of the lint which is conveyed out of the drying chamber 2 by the process air. It may be noted that the process air guide 4 including all components that are inserted into it needs not to be perfectly closed. To assure operation of the dryer 1, not more and not less is required generally than avoiding substantial losses of process air, to exclude substantial leakages of heat and/or humidity from the circuit. There is no necessity for a sealing that would withstand considerable pressure loads without breaking. Quite to the contrary, it will be desired to keep the pressure within the circuit more or less at the pressure level outside of the dryer 1.

As detailed earlier, the drying chamber 2 is configured as a rotatable drum; a motor 22 is provided to drive the drum 2 by means of a belt 23 and a pulley 24.

Other than the heat sink 5, the second filter 19 may be removed from dryer 1 for the purpose of cleaning, and the condensate container 8 may be removed from the dryer 1 for disposal of the condensate as well. It is noted that the joint 25 between the condensate container 8 and the liquid guide 12 needs to be configured in proper fashion, for example by providing a valve in the condensate container 8 which closes automatically as the condensate container 8 is removed from the dryer 1.

Finally it is noted that dryer 1 also includes a control unit 26. This control unit 26 will serve as an interface between the dryer 1 and its user, to allow a drying process to be properly configured as desired by the user, for example by selecting from a collection of predefined drying programs. Likewise, the control unit 26 will serve to operate and control all components which have been mentioned herein and require input of energy or control signals, or other controlling action. In addition, the control unit 26 may also be connected to sensors which are not shown in FIG. 1 for the sake of simplicity, which sensors may be applied to control a drying process in the dryer 1. All connections to and from the control unit 26 are not shown in FIG. 2 for the sake of simplicity.

Figure 2:
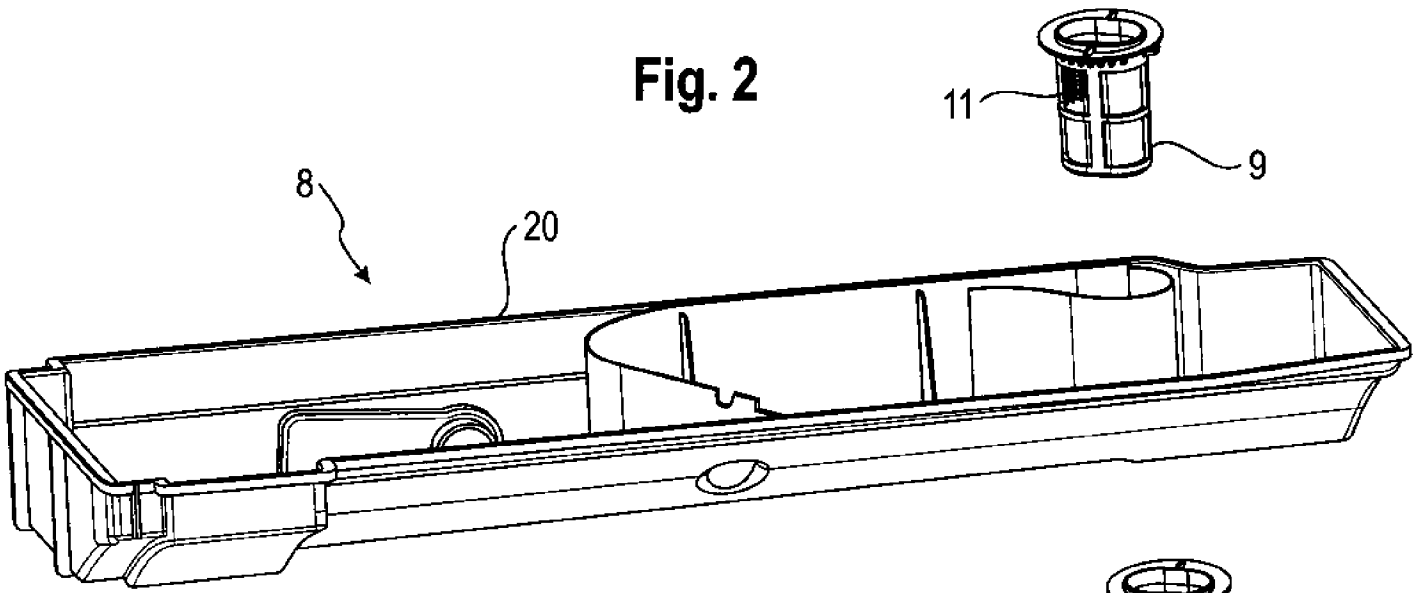
FIG. 2 and FIG. 3 each show a condensate container with an insert.
Figure 3:
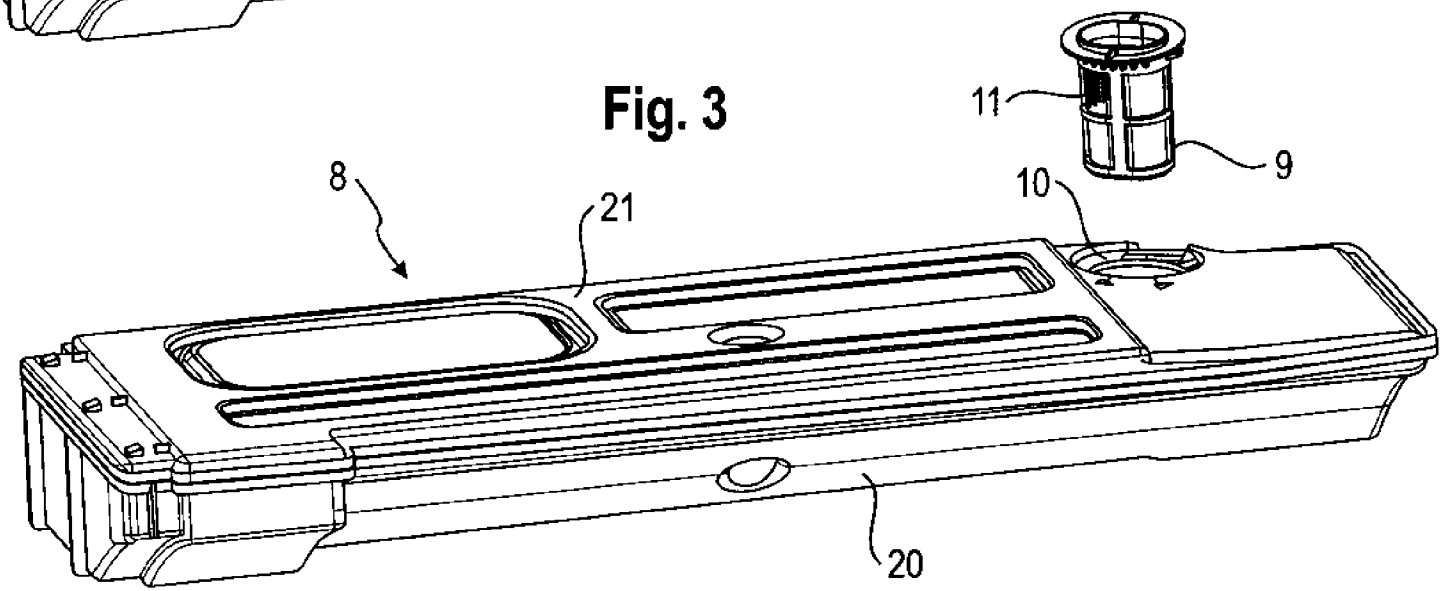

In FIGS. 2 and 3, some details of the condensate container 8 and the insert 9 are shown. While FIG. 2 shows only a body portion 20 of the condensate container 8, FIG. 3 shows the body portion 20 covered with an appropriate cover 21, where the cover 21 has the opening 10 for inserting the insert 9 that carries the first filter 11. This condensate container 8 is shaped more or less according to a generally known practice; it will be equipped with a handle that is not shown in FIG. 2 and FIG. 3, where the handle has a surface that will be visible within a front portion of the dryer 1 and is integrated smoothly into the front's overall design.

It should be noted that while according to FIG. 1 the valve 13 is shown at a distance from the condensate container 8, it may be desirable to place the valve 13 within that container 8, and arrange the valve 13 so as to have it always closed as the container 8 is withdrawn from the dryer 1. In this embodiment, the container 8 forms a self-contained unit with the valve 13, a unit which is removable from the dryer 1 to dispose of condensate and lint collected without any danger of spilling condensate.

Figure 5:
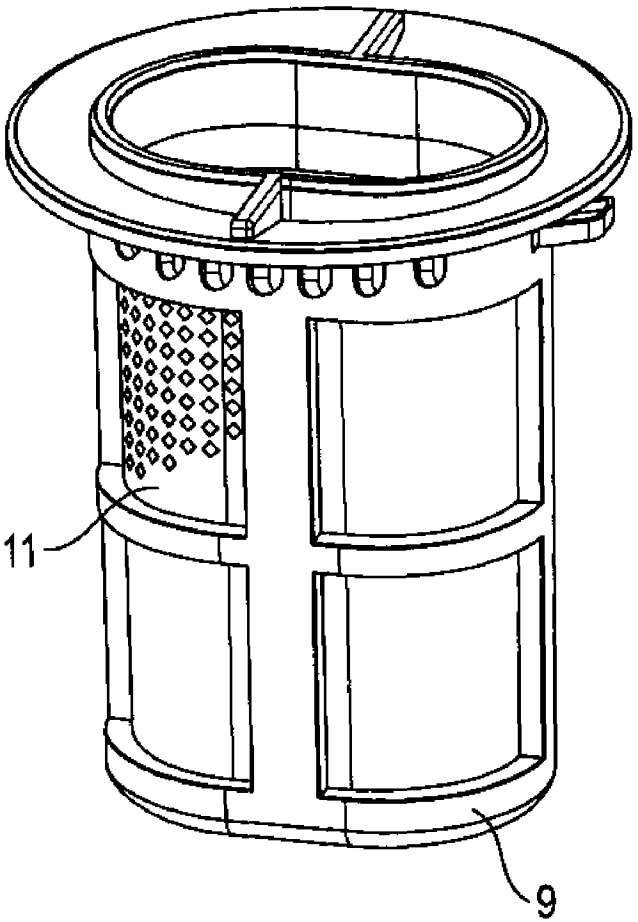
FIG. 4 and FIG. 5 each show an insert with a first filter.
Figure 4:
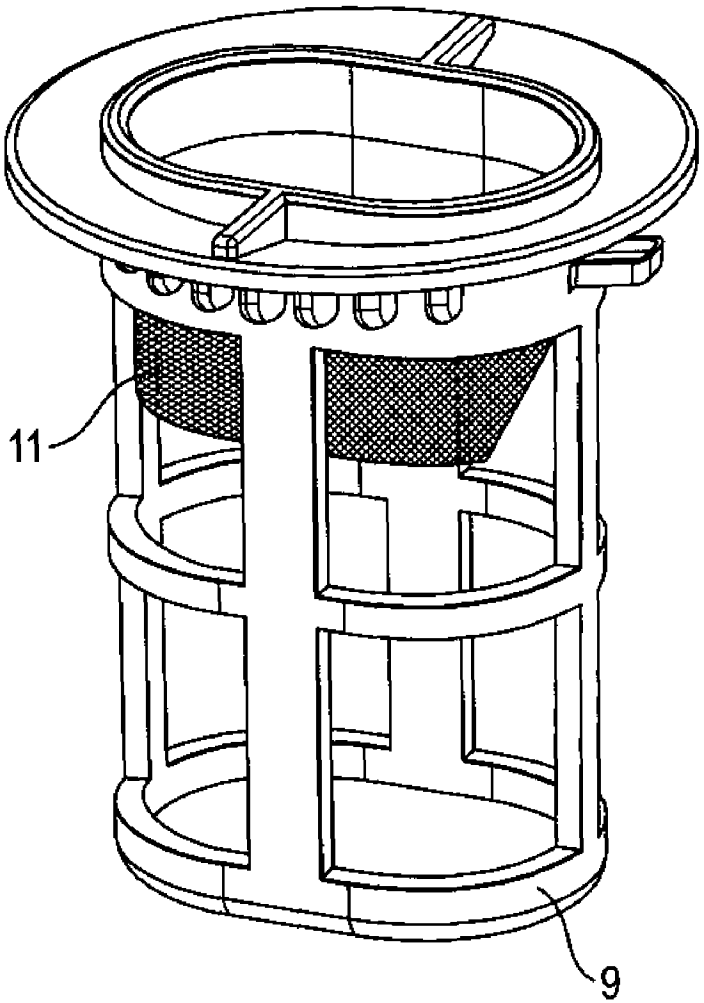

FIGS. 4 and 5 show two embodiments of the insert 9 and the first filter 11. According to FIG. 4, the first filter 11 is a mesh 11 formed from textiles or other threads. According to FIG. 5, the first filter 11 is a sheet-like structure provided with rectangular holes by stamping or the like.

The dryer provides for condensate collected through a drying process that is well cleaned for use in any cleaning purpose that may be scheduled in the dryer. Providing and using clean water from another source, in particular tap water can be avoided, contributing both to a positive ecological effect and to operational comfort for a user.

The invention claimed is:

1. A dryer comprising:

a drying chamber;

a process air guide that guides process air along the articles to pick up humidity from them;

a heat sink in the process air guide that precipitates humidity from the process air as a condensate; and a condensate collector with a condensate container having an insert that is permeable to the condensate and that projects through an opening into the condensate container for transferring the condensate to and from the condensate container, wherein the insert includes a first filter that filters particles from the condensate prior to storing the condensate in the condensate container.

2. The dryer of claim 1, wherein the insert is removably attached to the condensate container.

3. The dryer of claim 1, wherein the first filter comprises a permeable mesh.

4. The dryer of claim 3, wherein the mesh comprises a textile.

5. The dryer of claim 1, wherein the first filter is arranged to be flushed back for removing particles filtered from the condensate as condensate collected in the condensate container is poured out from the condensate container through the opening with the insert placed in the condensate container.

6. The dryer of claim 1, further comprising:

a cleaner that cleans particles sticking on the heat sink, wherein the cleaner comprises:

a liquid guide connected to the condensate container; and a valve that guides condensate from the condensate container to the heat sink; and a distributor that distributes the condensate over the heat sink.

7. The dryer of claim 1, wherein the heat sink belongs to a heat pump associated to the process air guide.

8. The dryer of claim 1, further comprising a blower in the process air guide that drives the process air through the process air guide.

9. The dryer of claim 1, wherein the process air guide comprises a second filter upstream of the heat sink that collects particles from the process air.

10. The dryer of claim 1, wherein the condensate container comprises a body and a cover to cover the body, and wherein the opening is defined by the cover.

11. The dryer of claim 1, wherein the process air guide comprises a substantially closed circuit.

12. The dryer of claim 1, wherein the drying chamber comprises a drum, and further comprising a motor that drives the drum for drying the articles.

13. The dryer of claim 1, wherein the condensate collector further comprises:

a condensate line that guides the condensate from the heat sink to the insert in the opening in the condensate container.

14. The dryer of claim 13, wherein the condensate collector further comprises:

a condensate pump that conveys the condensate through the condensate line to the insert in the opening in the condensate container.

15. The dryer of claim 1, wherein the condensate container comprises:

a body; and a cover that covers the body, wherein the opening is formed in the cover for transferring the condensate to and from the condensate container, wherein the insert projects through the opening into the cover of the condensate container, wherein the first filter is arranged to be flushed back for removing particles filtered from the condensate as the condensate collected in the condensate container is transferred out from the condensate container through the opening having the insert.

16. A dryer comprising:

a drying chamber having a drum and a motor that drives the drum, the drying chamber receiving articles for drying;

a process air guide that guides process air along the articles in the drying chamber to pick up humidity from the articles;

a heat sink in the process air guide that precipitates humidity from the process air as a condensate; and a condensate collector including:

a condensate container having a body, a cover that covers the body, and an opening in the cover for transferring the condensate to and from the condensate container; and an insert that is permeable to the condensate and that projects through the opening into the cover of the condensate container, wherein the insert includes a first filter that filters particles from the condensate transferred to the condensate container and prior to storing the condensate in the condensate container, wherein the first filter is arranged to be flushed back for removing particles filtered from the condensate as the condensate collected in the condensate container is transferred out from the condensate container through the opening having the insert.

17. The dryer of claim 16, wherein the condensate collector further comprises:

a condensate line that guides the condensate from the heat sink to the insert in the opening in the condensate container; and a condensate pump that conveys the condensate through the condensate line to the insert in the opening in the condensate container.

18. The dryer of claim 16, a cleaner that cleans particles from the heat sink, wherein the cleaner comprises:

a liquid guide connected to the condensate container;

a distributor that distributes the condensate over the heat sink; and a valve that controls a flow of the condensate from the condensate container, through the liquid guide, and to the distributor.

19. The dryer of claim 18, wherein the condensate collector further comprises:

a condensate line that guides the condensate from the heat sink to the insert in the opening in the condensate container.

20. The dryer of claim 19, wherein the condensate collector further comprises:

a condensate pump that conveys the condensate through the condensate line to the insert in the opening in the condensate container.

* * * * *